US012781302B2

(12) United States Patent
Kim et al.

(10) Patent No.: US 12,781,302 B2
(45) Date of Patent: Nov. 3, 2026

(54) HIGH STRENGTH HOT-DIP GALVANIZED STEEL SHEET HAVING EXCELLENT PLATING ADHESION AND WELDABILITY AND METHOD OF MANUFACTURING SAME

(71) Applicant: POSCO Co., Ltd, Pohang-si (KR)

(72) Inventors: Young-Ha Kim, Gwangyang-si (KR); Myung-Soo Kim, Gwangyang-si (KR); Kwang-Tai Min, Gwangyang-si (KR); Ki-Cheol Kang, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 546 days.

(21) Appl. No.: 18/267,342

(22) PCT Filed: Dec. 9, 2021

(86) PCT No.: PCT/KR2021/018625
§ 371 (c)(1),
(2) Date: Jun. 14, 2023

(87) PCT Pub. No.: WO2022/131673
PCT Pub. Date: Jun. 23, 2022

(65) Prior Publication Data

US 2024/0011119 A1 Jan. 11, 2024

(30) Foreign Application Priority Data

Dec. 18, 2020 (KR) ..... 10-2020-0179042

(51) Int. Cl.
*C21D 9/46* (2006.01)
*C21D 8/02* (2026.01)
(Continued)

(52) U.S. Cl.
CPC ..... *C21D 9/46* (2013.01); *C21D 8/0226* (2013.01); *C21D 8/0236* (2013.01); *C22C 38/02* (2013.01);
(Continued)

(58) Field of Classification Search
None
See application file for complete search history.

(56) References Cited

U.S. PATENT DOCUMENTS 6,451,128 B1 9/2002 Lee et al.
2006/0269776 A1 11/2006 Tanaka et al.
(Continued)

FOREIGN PATENT DOCUMENTS

CN 1231001 A 10/1999
CN 107109573 A 8/2017
(Continued)

OTHER PUBLICATIONS

The Extended European Search Report dated Feb. 18, 2025 issued in European Patent Application No. 21906977.0.
(Continued)

*Primary Examiner* — Anthony M Liang
(74) *Attorney, Agent, or Firm* — Morgan Lewis & Bockius LLP

(57) ABSTRACT

An embodiment of the present invention provides a high strength hot-dip galvanized steel sheet having excellent plating adhesion and weldability and a method of manufacturing same, wherein: the steel sheet comprises a base steel sheet and a hot-dip galvanized layer formed on one surface or both surfaces of the base steel sheet, the base steel sheet comprising, in weight %, carbon (C): 0.1-0.3%, silicon (Si): 0.1-2.0%, aluminum (Al): 0.1-1.5%, manganese (Mn): 1.5-3.0%, and the balance being Fe and inevitable impurities, the sum of Si and Al satisfying 1.2-3.5%, the ratio (Al/Si) of Al
(Continued)

(a)

(b)

and Si satisfying 0.5-2.0; the steel sheet comprises an internal oxidation layer with a thickness of 1-5 μm directly below the surface of the base steel sheet; and the decarburization rate in a region from directly below the surface of the base steel sheet to 50 μm is 50% or more.

6 Claims, 3 Drawing Sheets

(51) Int. Cl.

| | |
|---|---|
| ***C21D 8/0221*** | (2026.01) |
| ***C22C 38/02*** | (2006.01) |
| ***C22C 38/04*** | (2006.01) |
| ***C22C 38/06*** | (2006.01) |
| ***C23C 2/00*** | (2006.01) |
| ***C23C 2/06*** | (2006.01) |
| ***C23C 2/40*** | (2006.01) |
| ***C23G 1/00*** | (2006.01) |

(52) U.S. Cl.
CPC ..... *C22C 38/04* (2013.01); *C22C 38/06* (2013.01); *C23C 2/06* (2013.01); *C23C 2/40* (2013.01); *C23C 2/522* (2022.08); *C23G 1/00* (2013.01)

(56) References Cited

U.S. PATENT DOCUMENTS

| | | | |
|---|---|---|---|
| 2014/0234658 | A1 | 8/2014 | Nozaki et al. |
| 2016/0230259 | A1 | 8/2016 | Tanaka et al. |
| 2017/0369965 | A1 | 12/2017 | Ikeda et al. |
| 2018/0066344 | A1 | 3/2018 | Matsumoto et al. |
| 2018/0371570 | A1 | 12/2018 | Kim et al. |
| 2019/0024208 | A1 | 1/2019 | Kitazawa et al. |
| 2019/0040487 | A1 | 2/2019 | Enloe et al. |
| 2019/0185954 | A1 | 6/2019 | Kohsaka et al. |
| 2020/0079056 | A1 | 3/2020 | Kim et al. |
| 2020/0407833 | A1 | 12/2020 | Yoshida et al. |
| 2021/0047716 | A1 | 2/2021 | Sano et al. |
| 2022/0042155 | A1 | 2/2022 | Kang et al. |
| 2022/0195575 | A1 | 6/2022 | Sohn et al. |

FOREIGN PATENT DOCUMENTS

| | | | | |
|---|---|---|---|---|
| CN | 107429352 | A | | 12/2017 |
| EP | 3561140 | A1 | | 10/2019 |
| EP | 3392363 | B1 | | 3/2020 |
| JP | 2004-323970 | A | | 11/2004 |
| JP | 2008-019465 | A | | 1/2008 |
| JP | 2009-242949 | A | | 10/2009 |
| JP | 2011219782 | A | * | 11/2011 |
| JP | 5070862 | B2 | | 11/2012 |
| JP | 2015-054990 | A | | 3/2015 |
| JP | 6222040 | B2 | | 10/2017 |
| JP | 2019-504196 | A | | 2/2019 |
| JP | 2020-506286 | A | | 2/2020 |
| KR | 10-2014-0051669 | A | | 5/2014 |
| KR | 10-1726090 | B1 | | 4/2017 |
| KR | 10-2017-0076919 | A | | 7/2017 |
| KR | 10-2019-0077179 | A | | 7/2019 |
| KR | 10-2020-0076772 | A | | 6/2020 |
| KR | 10-2020-0123232 | A | | 10/2020 |
| WO | 2013/047836 | A1 | | 4/2013 |
| WO | 2017/145322 | A1 | | 8/2017 |
| WO | 2018/043453 | A1 | | 3/2018 |
| WO | 2019/187027 | A1 | | 10/2019 |
| WO | 2020/130631 | A1 | | 6/2020 |

OTHER PUBLICATIONS

Office Action dated Oct. 22, 2024 issued in corresponding Japanese Patent Application No. 2023-536458. (Note: US 2022-0042155 A1 previously submitted.).

International Search Report dated Mar. 29, 2022, issued in International Patent Application No. PCT/KR2021/018625 (with English translation).

Office Action dated Jan. 28, 2026 issued in the corresponding Chinese Patent Application No. 202180085899.X with the English translation, (Note: JP 2011-219782 A, US 2020-0407833 A1, and JP 2004-323970 A already submitted.).

Decision of Grant dated Jun. 15, 2026 issued in the corresponding Chinese Patent Application No. 202180085899.X.

* cited by examiner

【Fig. 1】
(a)
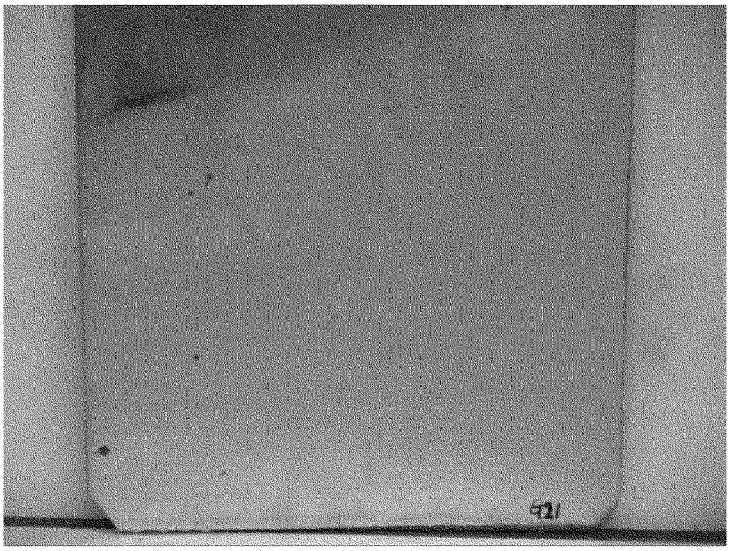
(b)
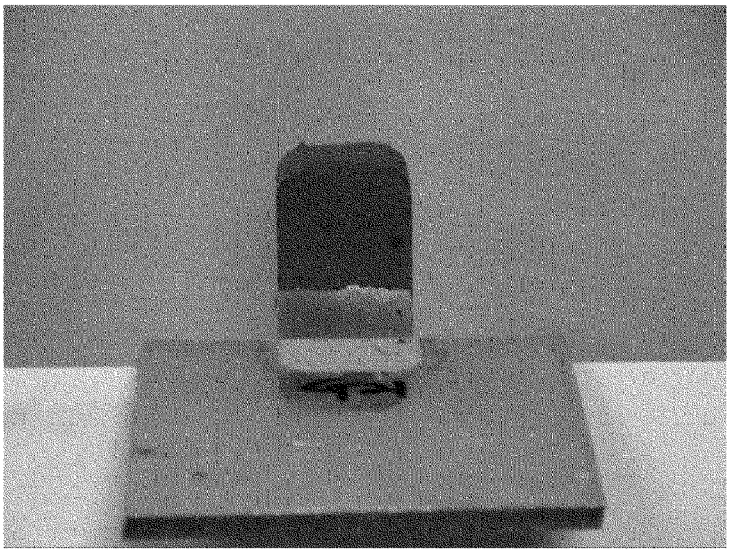

【Fig. 2】
(a)
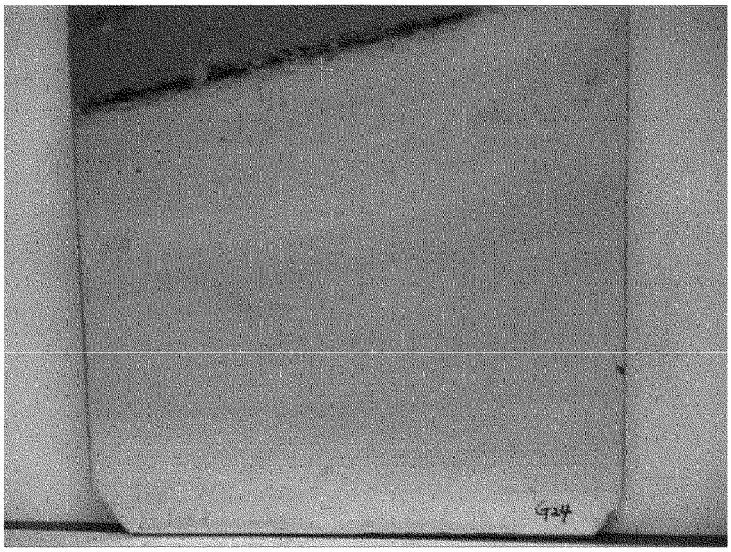
(b)
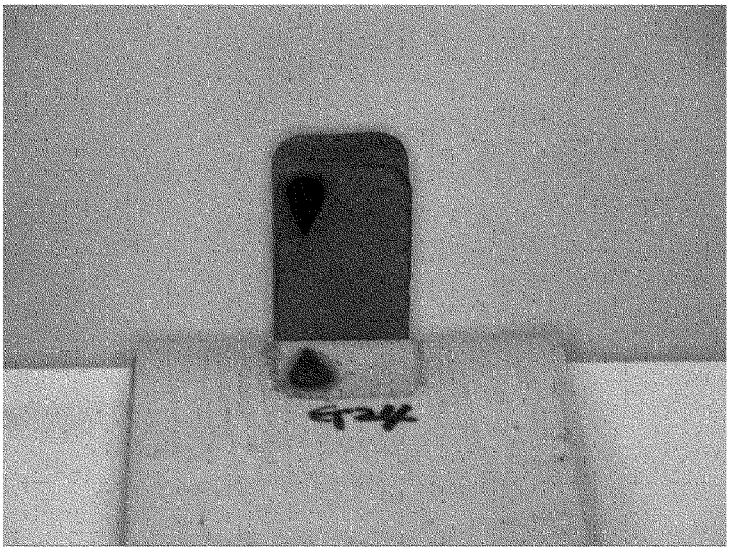

【Fig. 3】
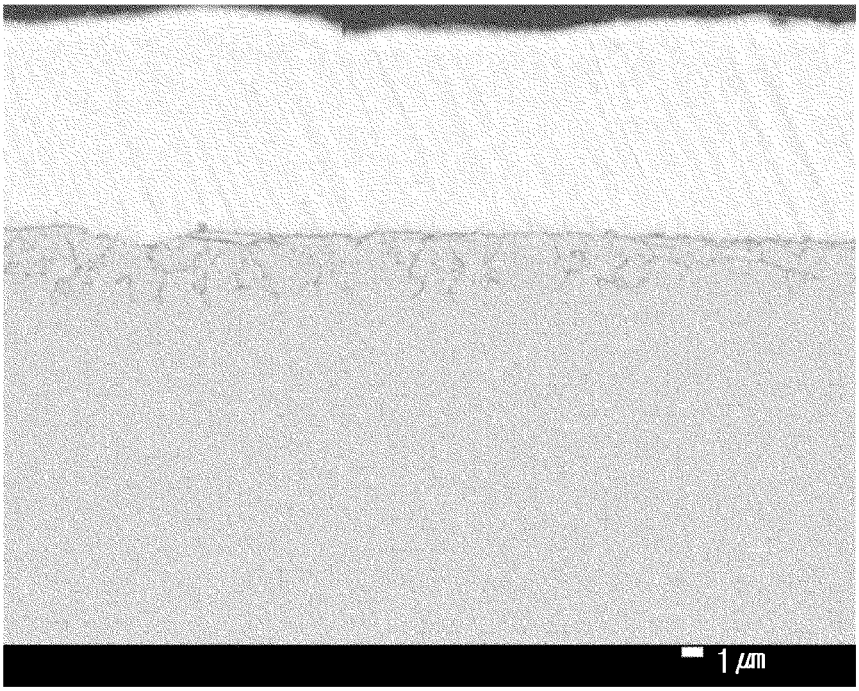

HIGH STRENGTH HOT-DIP GALVANIZED STEEL SHEET HAVING EXCELLENT PLATING ADHESION AND WELDABILITY AND METHOD OF MANUFACTURING SAME

CROSS-REFERENCE OF RELATED APPLICATIONS

This application is the U.S. National Phase under 35 U.S.C. § 371 of International Patent Application No. PCT/KR2021/018625, filed on Dec. 9, 2021, which in turn claims the benefit of Korean Application No. 10-2020-0179042, filed on Dec. 18, 2020, the disclosures of which applications are incorporated by reference herein.

TECHNICAL FIELD

The present disclosure relates to a high strength hot-dip galvanized steel sheet having excellent plating adhesion and weldability and a method of manufacturing the same.

BACKGROUND ART

With recently emerging environmental regulations, demand for ultra-high-strength steel sheets is rapidly increasing as a means to cope with strengthening of stringent automobile fuel efficiency regulations and crash safety regulations. In addition, fuel efficiency improvement is required to achieve carbon emission reduction targets by country, while a vehicle weight is continuously increasing due to the increase in high performance and various convenience devices. In order to solve these problems, the demand for ultra-high strength steel sheet is continuously increasing. Accordingly, steelmakers are concentrating on developing high-strength steel sheets such as dual phase (DP) steel, transformation induced plasticity (TRIP) steel, and complex phase (CP) steel.

In order to increase the strength of automotive steel sheets, it is common to add a large amount of elements such as Si, Mn, and Al to steel. However, as a steel sheet containing these elements has oxides generated on a surface of the steel sheet during an annealing heat treatment process, when the steel sheet is immersed in a hot-dip galvanizing bath, platability may deteriorate and plating peeling may occur. In addition, during the subsequent spot welding process, liquid metal embrittlement occurs in which liquid molten metal penetrates into a base metal grain boundary to cause cracks, to thereby make spot weldability deteriorate.

In order to improve platability of a steel sheet with a large amount of Si, Mn, and Al added, it is necessary to inhibit the oxides generated on the surface of the steel sheet. To this end, the amount of Si and Al added in the steel should be reduced. In this case, there is a problem in securing a target material.

A representative technique for solving this problem is disclosed in Patent Document 1. Patent Document 1 relates to a technique of inhibiting the formation of Si oxide or the like on the surface by preferentially concentrating at the grain boundary through the addition of trace components such as Sb in steel.

However, there is still a need for the development of a technology capable of more reliably preventing diffusion of alloy elements in steel when manufacturing a steel sheet.

RELATED ART DOCUMENT (Patent Document 1) Japanese Patent Publication No. 6222040

DISCLOSURE

Technical Problem

The present disclosure provides a high strength hot-dip galvanized steel sheet having excellent plating adhesion and weldability and a method of manufacturing the same.

Technical Solution

In an aspect in the present disclosure, a high strength hot-dip galvanized steel sheet having excellent plating adhesion and weldability may include a base steel sheet and a hot-dip galvanized layer formed on one surface or both surfaces of the base steel sheet, in which the base steel sheet may contain, in weight %, carbon (C): 0.1 to 0.3%, silicon (Si): 0.1 to 2.0%, aluminum (Al): 0.1 to 1.5%, manganese (Mn): 1.5 to 3.0%, and balance being Fe and inevitable impurities, a sum of Si and Al satisfies 1.2 to 3.5%, and a ratio (Al/Si) of Al and Si may satisfy 0.5 to 2.0, the base steel sheet may include an internal oxidation layer with a thickness of 1 to 5 μm directly below the surface of the base steel sheet, and a decarburization rate in a region from directly below the surface of the base steel sheet to 50 μm may be 50% or more.

In another aspect in the present disclosure, a method of manufacturing a high strength hot-dip galvanized steel sheet having excellent plating adhesion and weldability, the method may include: preparing a base steel sheet containing, in weight %, carbon (C): 0.1 to 0.3%, silicon (Si): 0.1 to 2.0%, aluminum (Al): 0.1 to 1.5%, manganese (Mn): 1.5 to 3.0%, and balance being Fe and inevitable impurities, a sum of Si and Al satisfying 1.2% or more, and a ratio of Al and Si (Al/Si) satisfying 0.5 to 2.0; cracking the base steel sheet in a temperature range of 750 to 900° C. in a gas atmosphere having a dew point temperature of 10 to 20° C. and containing 3 to 20% of hydrogen by volume, and balance being nitrogen and other inevitable impurities; and obtaining the hot-dip galvanized steel sheet by immersing the cracked base steel sheet in a hot-dip galvanizing bath at 440 to 460° C.

Advantageous Effects

As set forth above, according to the present disclosure, it is possible to provide a high strength hot-dip galvanized steel sheet having excellent plating adhesion and weldability and a method of manufacturing the same.

BRIEF DESCRIPTION OF THE DRAWINGS

FIG. 1 is an image of Inventive Example 1 according to an embodiment of the present disclosure, (a) is an image of a surface, and (b) is an image after a plating adhesion test.

FIG. 2 is an image of Comparative Example 3 according to an embodiment of the present disclosure, (a) is an image of a surface, and (b) is an image after a plating adhesion test.

FIG. 3 is an image of Inventive Example 1 according to an embodiment of the present disclosure observed by SEM.

BEST MODE

Hereinafter, a high strength hot-dip galvanized steel sheet having excellent plating adhesion and weldability according to an embodiment of the present disclosure will be described. The hot-dip galvanized steel sheet of the present disclosure has a base steel sheet and a hot-dip galvanized layer formed on one or both sides of the base steel sheet. First, the alloy composition of the base steel sheet of the present disclosure will be described in detail. The content of the alloy composition described below refers to weight % unless otherwise specified.

Carbon (C): 0.1 to 0.3%

C is an element that contributes to the stabilization of the austenite structure, and is advantageous in securing the austenite structure as its content increases. In order to obtain the above effect, the C content is preferably 0.1% or more. However, when the C content exceeds 0.3%, there is a problem that cast steel defects may occur and weldability is also deteriorated. Therefore, the content of C preferably ranges from 0.1 to 0.3%. The lower limit of the C content is more preferably 0.15%. The upper limit of the C content is more preferably 0.25%.

Silicon (Si): 0.1 to 2.0%

Silicon (Si) is an element contributing to stabilization of retained austenite by inhibiting precipitation of carbides in ferrite and promoting diffusion of carbon in ferrite to austenite. In order to obtain the above-described effect, it is preferable to add 0.1% or more of Si, but when the content exceeds 2.0%, not only the rollability is inferior, but also the oxide is formed on the surface of the steel sheet during the heat treatment process, resulting in poor plateability and adhesion. Therefore, the Si content preferably ranges from 0.1 to 2.0%. The lower limit of the Si content is more preferably 0.2%. The upper limit of the Si content is more preferably 1.8%.

Aluminum (Al): 0.1 to 1.5%

Aluminum (Al) is an element that deoxidizes by combining with oxygen in steel, and, like Si, Al is an element that contributes to the stabilization of retained austenite by inhibiting the formation of carbides in ferrite. In order to obtain the above-mentioned effect, it is preferable to add 0.1% or more of Al, but when the content exceeds 1.5%, the robustness of the slab deteriorates, and since the AL is an element with a strong oxygen affinity, oxides may be formed on the surface of the steel sheet, resulting in poor plateability and adhesion. Therefore, the Al content preferably ranges from 0.1 to 1.5%. The lower limit of the Al content is more preferably 0.2%. The upper limit of the Al content is more preferably 1.4%.

Manganese (Mn): 1.5 to 3.0%

The Mn is an element that stabilizes the austenite structure together with carbon. When the Mn content is less than 1.5%, it becomes difficult to secure the target strength due to the occurrence of ferrite transformation, and when the Mn content exceeds 3.0%, it is difficult to secure the target ductility due to the formation of martensite caused by a phase transformation delay during a secondary annealing heat treatment process. Therefore, the Mn content preferably ranges from 1.5 to 3.0%. The lower limit of the Mn content is more preferably 1.7%. The upper limit of the Mn content is more preferably 2.9%.

In addition to the steel composition described above, the remainder may include Fe and inevitable impurities. The inevitable impurities may be unintentionally mixed during the normal steel manufacturing process, and may not be completely excluded, and technicians in the normal steel manufacturing field may easily understand their meaning. Further, the present disclosure does not entirely exclude the addition of other compositions than the steel composition described above.

Meanwhile, as described above, both Si and Al are elements contributing to the stabilization of retained austenite, and in order to effectively achieve this, it is preferable that the sum of the content of Si and Al content satisfies the range of 1.2 to 3.5%. When the sum of the content of the Si and Al is less than 1.2%, it may be difficult to sufficiently obtain the effect of increasing elongation. On the other hand, when the sum of the content of Si and Al exceeds 3.5%, the castability and rollability may deteriorate. It is more preferable that the lower limit of the sum of the content of Si and Al is 1.3%. It is more preferable that the upper limit of the sum of the content of Si and Al is 3.4%.

In addition, the ratio of Al and Si (Al/Si) is preferably 0.5 to 2.0. When the ratio of Al to Si is less than 0.5, the plating peeling may occur as the Si-rich oxide is distributed in the form of a layer. On the other hand, when the ratio of Al and Si exceeds 2.0, the Al-rich oxide is densely formed on the surface of the steel sheet to inhibit the penetration of external oxygen into the steel sheet, so it may be difficult to form an internal oxide layer directly below the surface of the base steel sheet and the plateability and adhesion may deteriorate due to the Al-rich oxide formed in the form of the layer on the surface. The lower limit of the ratio of Al and Si is more preferably 0.6. The upper limit of the ratio of Al and Si is more preferably 1.9.

The hot-dip galvanized steel sheet of the present disclosure preferably includes an internal oxide layer having a thickness of 1 to 5 μm directly under the surface of the base steel sheet. One feature of the present disclosure is to improve the plateability by forming the internal oxide layer directly under the surface of the base steel sheet to prevent the Al or Si present in the base steel sheet from diffusing to the surface layer portion of the steel sheet and prevent the Al or Si oxide from being formed on the surface layer portion. However, when the thickness of the internal oxide layer is less than 1 μm, it may be difficult to sufficiently obtain the above effects. On the other hand, when the thickness of the internal oxide layer exceeds 5 μm or more, there is a disadvantage in that the oxides on the surface of the steel sheet are picked up by the roll during the annealing heat treatment process, resulting in surface defects such as dents. Therefore, the thickness of the internal oxide layer is preferably 1 to 5 μm. The lower limit of the internal oxide layer is more preferably 1.5 μm, and even more preferably 2 μm. The upper limit of the internal oxide layer is more preferably 4 μm, and even more preferably 3.5 μm.

The internal oxide layer may include oxides formed of the Al and Si composite oxide. In this way, by allowing the oxide to form the Al and Si composite oxide, the oxide is formed in an intermittent form rather than a continuous form such as a layer, so it is possible to improve the plating adhesion.

The Al and Si composite oxide may exist both within a grain or at a grain boundary. In this case, it is preferable that the Al and Si composite oxide is intermittently present. In this way, by allowing the Al and Si composite oxide to exist intermittently, it may be advantageous to secure the plating adhesion compared to continuously existing.

Meanwhile, the hot-dip galvanized steel sheet of the present disclosure preferably has a decarburization rate of 50% or more in a region from directly below the surface of the base steel sheet to 50 μm. As suggested by the present disclosure, when the dew point temperature in the heat treatment furnace is high, internal oxides are formed on the steel sheet surface layer portion, and at the same time, C in the steel reacts with oxygen adsorbed on the steel sheet surface to gasify CO or $CO_2$. A C depletion region is formed on the surface layer portion of the base material, and when this decarburization reaction occurs, the spot welding LME crack resistance becomes excellent. However, when the decarburization rate is less than 50%, the decarburization reaction is not sufficient and the LME crack resistance may deteriorate.

The hot-dip galvanized steel sheet of the present disclosure provided as described above has a yield strength of 600 MPa or more, a tensile strength of 950 MPa or more, and an elongation of 20% or more, so it is possible to secure excellent mechanical properties. In addition, the area of the hot-dip galvanized layer compared to the total area of the base steel sheet is 95% or more, and the plating adhesion is good, so it is possible to have excellent plateability. In addition, since the LME crack maximum length is 50 μm or less, the hot-dip galvanized layer may have excellent LME crack resistance.

Hereinafter, a method of manufacturing a high strength hot-dip galvanized steel sheet having excellent plating adhesion and weldability according to an embodiment of the present disclosure will be described.

First, a base steel sheet that satisfies the above-described alloy composition is prepared. In the present disclosure, a method of preparing a base steel sheet is not particularly limited. However, as a preferred example, the step of preparing the base steel sheet may include reheating the slab at 1000 to 1300° C.; obtaining a hot-rolled steel sheet by hot finish rolling the reheated slab at 800 to 950° C.; winding the hot-rolled steel sheet at 630 to 700° C.; and obtaining a cold-rolled steel sheet by pickling the wound hot-rolled steel sheet and then cold-rolling the wound hot-rolled steel sheet.

The slab satisfying the above-described alloy composition is reheated at 1000 to 1300° C. When the slab reheating temperature is below 1000° C., a problem may occur in which the rolling load significantly increases, and when the slab reheating temperature exceeds 1300° C., a problem may occur in which the surface scale is excessive. Therefore, the slab reheating temperature preferably ranges from 1000 to 1300° C. The lower limit of the slab reheating temperature is more preferably 1050° C. The upper limit of the slab reheating temperature is more preferably 1250° C.

Thereafter, the reheated slab is hot finish rolled at 800 to 950° C. to obtain the hot-rolled steel sheet. When the hot finish rolling temperature is below 800° C., the rolling load increases, which makes rolling difficult, and when the hot finish rolling temperature exceeds 950° C., the roll life is shortened due to the increase in thermal fatigue of the rolling rolls. Therefore, the hot finish rolling temperature preferably ranges from 800 to 950° C. The lower limit of the hot finish rolling temperature is more preferably 830° C. The upper limit of the hot finish rolling temperature is more preferably 930° C.

Thereafter, the hot-rolled steel sheet is wound at 630 to 700° C. When the winding temperature is below 630° C., the formation of oxides on the surface layer portion of the steel sheet may be promoted during the annealing heat treatment process as the internal oxide layer is not formed, resulting in poor plateability, and when the winding temperature exceeds 700° C., since the depth of the internal oxide layer is considerably deep, oxide is picked up on the roll during the subsequent annealing heat treatment process, which may cause the surface defects such as dents. Therefore, the winding temperature preferably ranges from 630 to 700° C. The lower limit of the winding temperature is more preferably 650° C. The upper limit of the winding temperature is more preferably 680° C.

Thereafter, the wound hot-rolled steel sheet is pickled and then cold-rolled to obtain a cold-rolled steel sheet. In the present disclosure, the pickling and cold rolling processes are not particularly limited, and all the methods commonly performed in the art may be used.

The prepared base steel sheet is cracked in a temperature range of 750 to 900° C. in a gas atmosphere containing a dew point temperature of 10 to 20° C., 3 to 20 vol % of hydrogen, and the balance being nitrogen and other inevitable impurities. The cracking means heating to the above temperature range and then maintaining it. When the dew point temperature is below 10° C., local internal oxidation does not sufficiently occur, so there is a limit to effectively inhibiting the surface concentration of Si and Mn in steel, and the decarburization effect is not sufficient, resulting in poor LME crack resistance. On the other hand, when the temperature exceeds 20° C., the plating peeling may occur due to Fe oxide as much as the dew point region in which Fe may be oxidized. When the fraction of hydrogen in the gas is less than 3 volume %, sufficient reducing ability may not be secured, so Fe oxide, etc., may remain on the surface of the steel sheet to cause the unplating or plating peeling, and when the fraction of hydrogen exceeds 20 volume %, there is a disadvantage in that the cost increases as a large amount of expensive hydrogen is used. When the cracking temperature is below 750° C., the recrystallization temperature of A3 or higher may not be secured, and deviations in mechanical properties may occur due to the non-recrystallized region, and the internal oxidation does not occur, so Si, Mn, etc., diffuse to the surface of the steel sheet to form oxides, resulting in poor plating quality. On the other hand, in the case of exceeding 900° C., there is a limit to increasing the temperature of the steel sheet due to the limitations of the heat treatment equipment, and there is a disadvantage that a steel sheet of excellent material may not be obtained by secondary recrystallization.

Thereafter, the cracked base steel sheet is immersed in the hot-dip galvanizing bath at 440 to 460° C. to obtain the hot-dip galvanized steel sheet. When the temperature of the hot-dip galvanizing bath is less than 440° C., the viscosity of the plating bath increases and the mobility of the roll winding the steel sheet decreases, resulting in the slip between the steel sheet and the roll and the defects in the steel sheet, and when the temperature of the hot-dip galvanizing bath exceeds 460° C., the phenomenon that the steel sheet is dissolved in the plating bath is promoted, and the generation of dross in the form of Fe—Zn compounds is accelerated, resulting in the surface defects.

Meanwhile, after the step of obtaining the hot-dip galvanized steel sheet, the method may further include performing alloying heat treatment on the hot-dip galvanized steel sheet at 480 to 600° C. When the alloying heat treatment temperature is less than 480° C., Fe in the base material may not sufficiently diffuse into the plating layer, so the Fe content in the plating layer may not be sufficiently secured, and when the alloying heat treatment exceeds 600° C., the content of Fe in the plating layer is excessive, a powdering phenomenon may occur in which the plating layer is removed during the processing of the steel sheet.

MODE FOR INVENTION

Hereinafter, the present disclosure will be described in more detail with reference to Examples. However, the following examples are only examples for describing the present disclosure in more detail, and do not limit the scope of the present disclosure.

Example

After molten metal having alloy compositions shown in Table 1 was prepared into an ingot having a width of 175 mm and a thickness of 90 mm in a vacuum melting furnace, the molten metal was subjected to homogenization treatment performed by reheating at 1200° C. for 1 hour, and hot finish rolling at 900° C. which is a temperature of Ar3 or higher, and then maintained at 680° C. for 1 hour, to thereby simulate the hot-rolled winding. Thereafter, the hot-rolled steel sheet was immersed in 15% HCl pickling solution for 40 seconds to simulate the pickling process. Thereafter, the cold-rolled steel sheets were manufactured by cold rolling at a cold rolling reduction of 50 to 60%. After this cold-rolled steel sheet was subjected to cracking treatment in a reducing furnace at 800° C. in a gas atmosphere of 5 vol % H+95 vol % N having the dew point temperature conditions shown in Table 2 below, cooled, and immersed in a hot-dip galvanizing bath of 460° C. for 5 seconds, the plating adhesion amount was controlled to 60 g/m$^2$ based on one side through air wiping, to thereby manufacture the hot-dip galvanized steel sheet.

The mechanical properties, the thickness of the internal oxide layer, the plateability, the decarburization rate, and the LME crack maximum length were measured for the hot-dip galvanized steel sheet prepared as described above, and the results were shown in Table 2 below. Meanwhile, the measured oxide was Al and Si composite oxide.

For the mechanical properties, after the hot-dip galvanized steel sheet was cut into 40 mm×200 mm in size in a vertical direction of a rolling direction, and a side surface thereof was milled and ground, a tensile specimen was prepared in accordance with JIS No. 5 standard, and yield strength (YS), tensile strength (TS), and elongation (EL) of the tensile specimen were measured with a tensile tester.

The thickness of the internal oxide layer was measured at 5000 magnification by randomly selecting 10 locations from cross-section microstructure photographs obtained through the scanning electron spectroscopy (SEM), and then, the average value was described.

The plateability was evaluated by measuring the formation area of the hot-dip galvanized layer compared to the total area of the hot-dip galvanized steel sheet by image analysis to measure the fraction, and by applying the structural adhesive on the hot-dip galvanized steel sheet, curing the structural adhesive at 175° C. for 20 minutes, and then checking whether the adhesive came out on a sealer (plating adhesion) when bending at 90°.

The decarburization rate was indicated by measuring a C profile on a glow discharge optical emission spectroscopy (GDOES) depth profile to about 50 μm in the depth direction of the base steel sheet and then measuring the fraction of the depleted area relative to the total area on the profile.

The maximum length of the LME cracks was measured by laminating the steel sheets, applying welding current using a Cu—Cr electrode having a tip diameter of 6 mm, welding under the conditions of 16 cycles of energization time and 15 cycles of holding time with a pressing force of 2.6 kN, and then observing a cross section of a slope of an area boundary, where the welding rod electrode and the steel sheet contact with each other, by an optical microscope.

TABLE 1

| Steel | Alloy Composition (weight %) | | | | | |
|---|---|---|---|---|---|---|
| Type No. | C | Si | Al | Mn | Al + Si | Al/Si |
| Inventive Steel 1 | 0.21 | 0.50 | 0.80 | 2.7 | 1.30 | 1.60 |
| Inventive Steel 2 | 0.22 | 0.65 | 0.75 | 2.6 | 1.40 | 1.15 |
| Inventive Steel 3 | 0.23 | 0.71 | 0.62 | 2.6 | 1.33 | 0.87 |
| Inventive Steel 4 | 0.21 | 0.66 | 0.76 | 2.8 | 1.42 | 1.15 |
| Comparative Steel 1 | 0.22 | 1.00 | 0.30 | 2.7 | 0.80 | 0.30 |
| Comparative Steel 2 | 0.20 | 0.40 | 1.00 | 2.8 | 2.00 | 2.50 |
| Comparative Steel 3 | 0.22 | 0.98 | 0.25 | 2.7 | 0.65 | 0.26 |
| Comparative Steel 4 | 0.23 | 0.35 | 0.60 | 2.8 | 0.95 | 1.71 |
| Inventive Steel 5 | 0.21 | 0.70 | 0.70 | 2.7 | 1.40 | 1.00 |

TABLE 2

| Division | Steel Type No. | Dew point temperature (° C.) | Yield strength (MPa) | Tensile strength (MPa) | Elongation (%) | Thickness of internal oxide layer (μm) | Platability: Area fraction of plating layer (%) | Platability: Plating adhesion | Decarburization rate (%) | Maximum length of LME crack (μm) |
|---|---|---|---|---|---|---|---|---|---|---|
| Inventive Example 1 | Inventive Steel 1 | 14 | 744 | 1044 | 22.0 | 2.5 | 98 | Non-peeling | 69 | 45 |
| Inventive Example 2 | Inventive Steel 2 | 15 | 762 | 1058 | 22.4 | 2.6 | 97 | Non-peeling | 72 | 43 |
| Inventive Example 3 | Inventive Steel 3 | 10 | 756 | 1051 | 22.1 | 2.2 | 96 | Non-peeling | 65 | 48 |
| Inventive Example 4 | Inventive Steel 4 | 13 | 768 | 1049 | 22.6 | 2.4 | 95 | Non-peeling | 68 | 46 |
| Comparative Example 1 | Comparative Steel 1 | −25 | 722 | 1033 | 23.1 | 0.6 | 96 | Peeling | 31 | 128 |
| Comparative Example 2 | Comparative Steel 2 | −38 | 766 | 1057 | 22.5 | 0.5 | 87 | Peeling | 28 | 133 |
| Comparative Example 3 | Comparative Steel 3 | −11 | 670 | 1022 | 20.9 | 0.7 | 98 | Peeling | 36 | 115 |

TABLE 2-continued

| Division | Steel Type No. | Dew point temperature (° C.) | Yield strength (MPa) | Tensile strength (MPa) | Elongation (%) | Thickness of internal oxide layer (μm) | Platability: Area fraction of plating layer (%) | Platability: Plating adhesion | Decarburization rate (%) | Maximum length of LME crack (μm) |
|---|---|---|---|---|---|---|---|---|---|---|
| Comparative Example 4 | Comparative Steel 4 | 0 | 505 | 989 | 18.9 | 1.3 | 98 | Non-peeling | 44 | 105 |
| Comparative Example 5 | Inventive Steel 5 | 5 | 742 | 1039 | 21.7 | 1.6 | 98 | Non-peeling | 47 | 102 |

As can be seen from Tables 1 and 2, it could be seen that Inventive Examples 1 to 4 satisfying the alloy composition and manufacturing conditions proposed by the present disclosure secured the thickness of the internal oxide layer and the decarburization rate to be obtained by the present disclosure to obtain excellent plateability and LME crack resistance.

On the other hand, it could be seen that, as Comparative Examples 1 and 3 not only had Al/Si lower than the Al/Si proposed by the present disclosure, but also did not secure the thickness of the internal oxide layer and the decarburization rate proposed by the present disclosure due to the very low dew point temperature, the plating adhesion and LME crack resistance deteriorated.

It could be seen that, as Comparative Example 2 not only had Al/Si exceeding, as the Al/Si proposed by the present disclosure, but also did not secure the thickness of the internal oxide layer and the decarburization rate proposed by the present disclosure due to the very low dew point temperature, the non-plating, plating adhesion, and LME crack resistance deteriorated.

It could be seen that, as Comparative Example 4 did not satisfy the sum of Si and Al proposed by the present disclosure, the elongation is low, and as the Comparative Example 4 did not secure the decarburization rate proposed by the present disclosure due to the low dew point temperature, the LME crack resistance deteriorated.

It could be seen that, as Comparative Example 5 satisfied the alloy composition proposed by the present disclosure, but failed to secure the decarburization rate proposed by the present disclosure due to the low dew point temperature, the LME crack resistance deteriorated.

FIG. 1 is an image of Inventive Example 1, and (a) is an image of a surface, and (b) is an image after a plating adhesion test. FIG. 2 is an image of Comparative Example 3, and (a) is an image of a surface, and (b) is an image after a plating adhesion test. As can be seen from FIGS. 1 and 2, it could be seen that Inventive Example 1 had almost no unplated region and did not cause the peeling of the plating layer, resulting in good plating quality, whereas Comparative Example 3 had almost no unplated region, but caused the peeling of the plating layer, resulting in poor plating quality.

FIG. 3 is an image of Inventive Example 1 observed by SEM. As can be seen from FIG. 3, it could be seen that in Inventive Example 1, an internal oxide layer containing an intermittently present oxide was formed to an appropriate thickness.

The invention claimed is:

1. A hot-dip galvanized steel sheet, comprising:

a base steel sheet; and a hot-dip galvanized layer formed on at least one surface of the base steel sheet, wherein the base steel sheet contains, in weight %, carbon (C): 0.1 to 0.3%, silicon (Si): 0.1 to 2.0%, aluminum (Al): 0.1 to 1.5%, manganese (Mn): 1.5 to 3.0%, and balance being Fe and inevitable impurities, a sum of Si and Al satisfies 1. 2 to 3. 5%, and a ratio (Al/Si) of Al and Si satisfies 0.5 to 2.0, the base steel sheet includes an internal oxidation layer with a thickness of 1-5 μm directly below the at least one surface of the base steel sheet, and a decarburization rate in a region from directly below the at least one surface of the base steel sheet to 50 μm is 50% or more.

2. The hot-dip galvanized steel sheet of claim 1, wherein the internal oxide layer includes oxide formed of an Al and Si composite oxide.

3. The hot-dip galvanized steel sheet of claim 2, wherein the oxide exists intermittently.

4. The hot-dip galvanized steel sheet of claim 1, wherein the hot-dip galvanized steel sheet has a yield strength of 600 MPa or more, a tensile strength of 950 MPa or more, and an elongation of 20% or more.

5. The hot-dip galvanized steel sheet of claim 1, wherein, in the hot-dip galvanized steel sheet, an area of the hot-dip galvanized layer compared to a total area of the base steel sheet is 95% or more.

6. The hot-dip galvanized steel sheet of claim 1, wherein the hot-dip galvanized steel sheet has an LME crack maximum length of 50 μm or less.

* * * * *